US008118541B2

(12) United States Patent
Ou et al.

(10) Patent No.: US 8,118,541 B2
(45) Date of Patent: Feb. 21, 2012

(54) MULTI-FUNCTIONAL AIR CIRCULATION SYSTEM

(75) Inventors: Jih-I Ou, Tainan (TW); Ching-Shu Huang, Tainan (TW)

(73) Assignees: Jih-I Ou, Tainan (TW); Hern Juei Co., Ltd., Tainan (TW)

( * ) Notice: Subject to any disclaimer, the term of this patent is extended or adjusted under 35 U.S.C. 154(b) by 951 days.

(21) Appl. No.: 12/121,491

(22) Filed: May 15, 2008

(65) Prior Publication Data

US 2009/0280007 A1 Nov. 12, 2009

(51) Int. Cl.
*F01D 1/02* (2006.01)
*F03B 11/02* (2006.01)

(52) U.S. Cl. ..... 415/121.2; 415/126; 415/127; 415/213.1

(58) Field of Classification Search ..... 415/121.2, 415/126, 127, 213.1
See application file for complete search history.

(56) References Cited

U.S. PATENT DOCUMENTS 4,377,399 A * 3/1983 Bryson ..... 96/222
4,627,862 A * 12/1986 Frei et al. ..... 96/25
4,629,482 A * 12/1986 Davis ..... 55/385.2
5,102,435 A * 4/1992 Rau et al. ..... 55/467
5,435,817 A * 7/1995 Davis et al. ..... 55/337
6,156,085 A * 12/2000 Chiu et al. ..... 55/357
6,616,722 B1 * 9/2003 Cartellone ..... 55/459.3

FOREIGN PATENT DOCUMENTS

TW 366963 1/1999

* cited by examiner

*Primary Examiner* — Igor Kershteyn
(74) *Attorney, Agent, or Firm* — J.C. Patents

(57) ABSTRACT

A multi-functional air circulation system includes a bottom base, a flow-splitting base, a filter and a main engine. The bottom base has a lower flow-guiding surface, a net, and a space used to contain diverse improving agents. The flow-splitting base is fixed on the bottom base, including an inner flow-guiding surface to rush air flow generated by a blade member down to the bottom base. The filter is laid at an exit of the inner flow-guiding surface, composed of two filter bases forming a room between them for containing aromatic powder, etc. The main engine includes a motor having its shaft fixed with a blade member, and a control system. The motor is installed in a rear shell combined with a front shell. Air is sucked in through the rear shell to run through an ornamental shell and the flow-splitting base to enter a room. The main engine and the bottom base can also be assembled to work independently.

18 Claims, 14 Drawing Sheets

MULTI-FUNCTIONAL AIR CIRCULATION SYSTEM

CROSS-REFERENCE TO RELATED APPLICATION

This application claims the priority benefit of Taiwan application serial No. 97116706 filed on May 6, 2008, the content of which is incorporated herein by reference in its entirety.

BACKGROUND OF THE INVENTION

1. Field of the Invention

This invention relates to a multi-functional air circulation system, particularly to one having its main engine and its bottom base differently assembled, so that it can be used as a fan only or a fan with additional functions, such as dispersing fragrance, getting rid of bugs, filtering off impurities in air and humidifying air.

2. Description of the Prior Art

As disclosed in a Taiwan patent No. 366963 "MULTI-FUNCTIONAL ELECTRIC FAN", the conventional fan includes a left and a right positioning base provided in a lower cover of a main body, with the left positioning base installed with a motor for forcing a driving mechanism to keep a driving rack moving up and down. The lower cover of the main body is provided with a base located at its bottom for pivotally connected with a linking rod. An upper cover is located above the lower cover of the main body, provided with a motor hood groove, a linking rod groove for fitting the linking rod, a rack hole for the driving rack to pass through, and an essence groove used for containing essence. The top of the driving rack can be pivotally fixed with an ear of a rear fan covering. The linking rod has its front end pivotally fixed at a center of a lower portion of the rear fan covering. A motor is installed in a motor hood that is positioned on the rear fan covering. Located in front of the rear fan covering is a front fan covering, and a fan is installed between the front fan covering and the rear fan covering.

However, as the essence groove is additionally installed in the upper cover of the main body and the fan must be driven by the additional driving rod, the conventional fan is obviously composed of complicated components, posing a high manufacturing cost.

SUMMARY OF THE INVENTION

One object of this invention is to offer a multi-functional air circulation system able to disperse fragrance, to get rid of bugs, to filter off impurities in air, and to humidify air.

Another object of this invention is to offer a multi-functional air circulation system to work merely as a fan.

The main characteristics of the invention are a bottom base, a flow-splitting base, a filter and a main engine. The bottom base is provided with a lower flow-guiding surface formed in its bottom, an annular groove formed around the center of the lower flow-guiding surface for containing aromatic, an upper cap sealed on the annular groove, and a net employed to contain an absorptive paper to keep air humidified. The flow-splitting base is positioned on the bottom base, provided with an inner flow-guiding surface able to rush air flow generated by a blade member down to the bottom base. The filter is positioned in an exit of the inner flow-guiding surface, composed of two filter bases. A space is formed between the filter bases, used to accommodate environmental improving agents, such as aromatic powder, active carbon powder or blocks. The main engine mainly includes a motor having its shaft fixed with a blade member, and a control system. The motor is covered by a shade, through which air is sucked in after initiating the blade member and then, orderly blown through a front shell, the flow-splitting base, the lower flow-guiding surface and annular exits of the flow-splitting base to disperse in a room. Moreover, a rear shell of the main engine can be provided with a long groove employed to engage with a positioning knob of the bottom base, so that the main engine can work independently as merely a fan.

BRIEF DESCRIPTION OF DRAWINGS

This invention is better understood by referring to the accompanying drawings, wherein.

DETAILED DESCRIPTION OF THE PREFERRED EMBODIMENT

Figure 1:
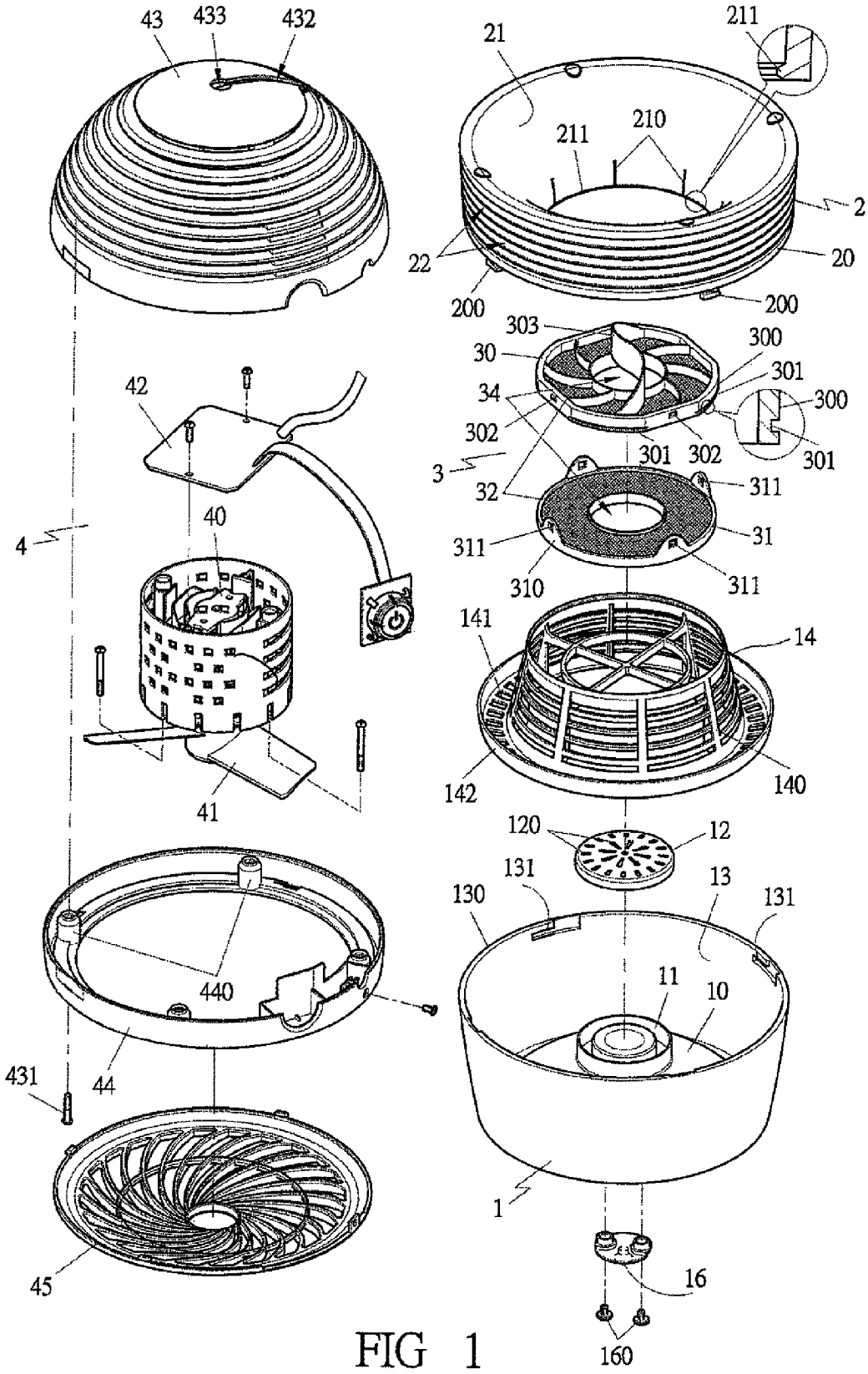
FIG. 1 is an exploded perspective view of a first preferred embodiment of a multi-functional air circulation system in the present invention.

As shown in FIGS. 1~6, a first preferred embodiment of a multi-functional air circulation system in the present invention includes a bottom base 1, a flow-splitting base 2, a filter 3 and a main engine 4.

The bottom base 1 is provided with a lower flow-guiding surface 10 formed in its bottom, an annular groove 11 formed around the center of the lower flow-guiding surface 10 for containing a liquid or solid aromatic, an upper cap 12 sealed on the annular groove 11, and an annular wall 13 extending upward around the circumference of the lower flow-guiding surface 10. A plurality of holes 120 are densely bored in the upper cap 12, employed to enable the flavor of the aromatic contained in the annular groove 11 carried by air flow to disperse in a room. The annular wall 13 is provided with plural locking holes 131 bored near an edge of an upper annular wall 130.

Figure 4:
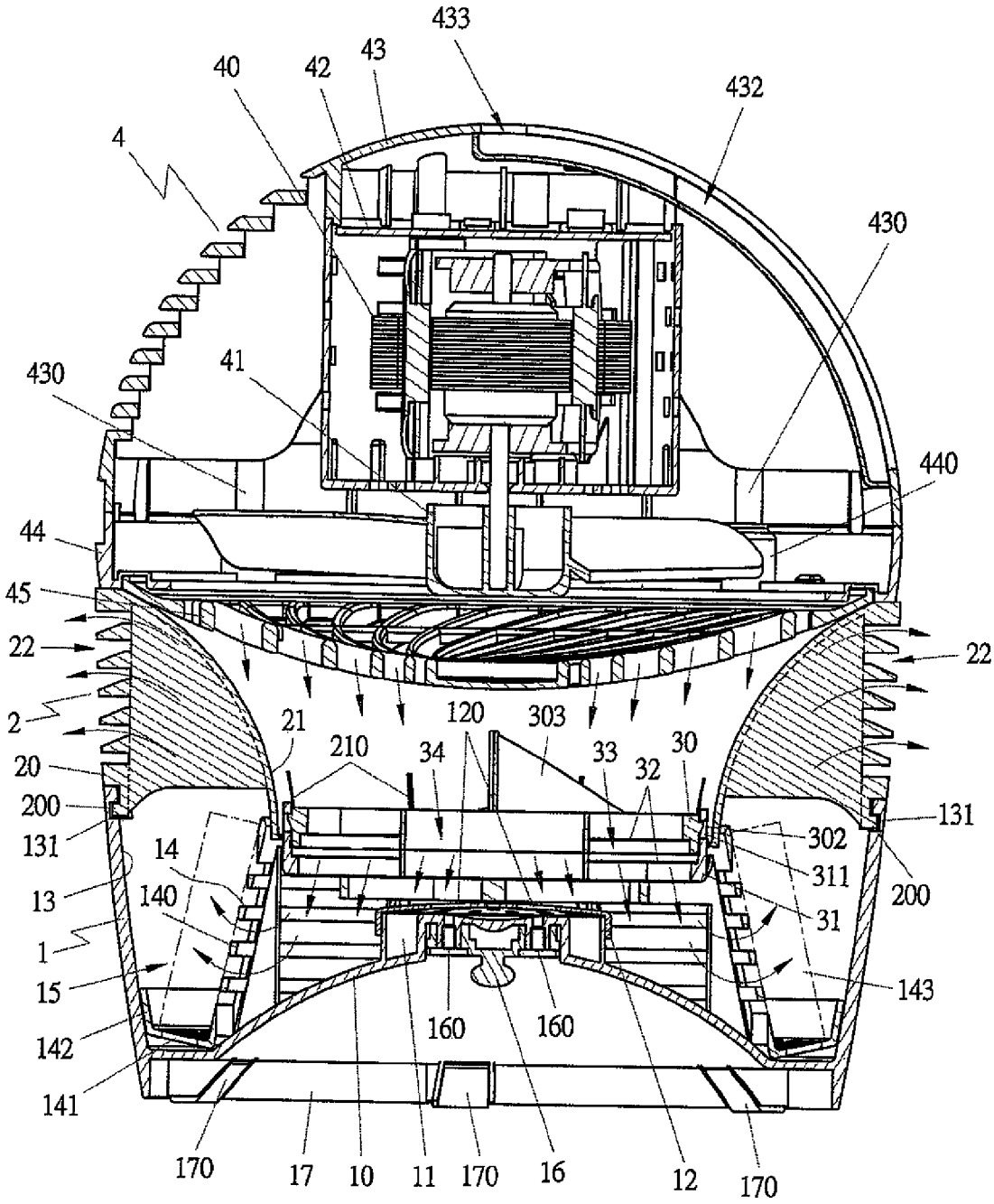
FIG. 4 is a cross-sectional view of the line A-A in FIG. 3.
Figure 6:
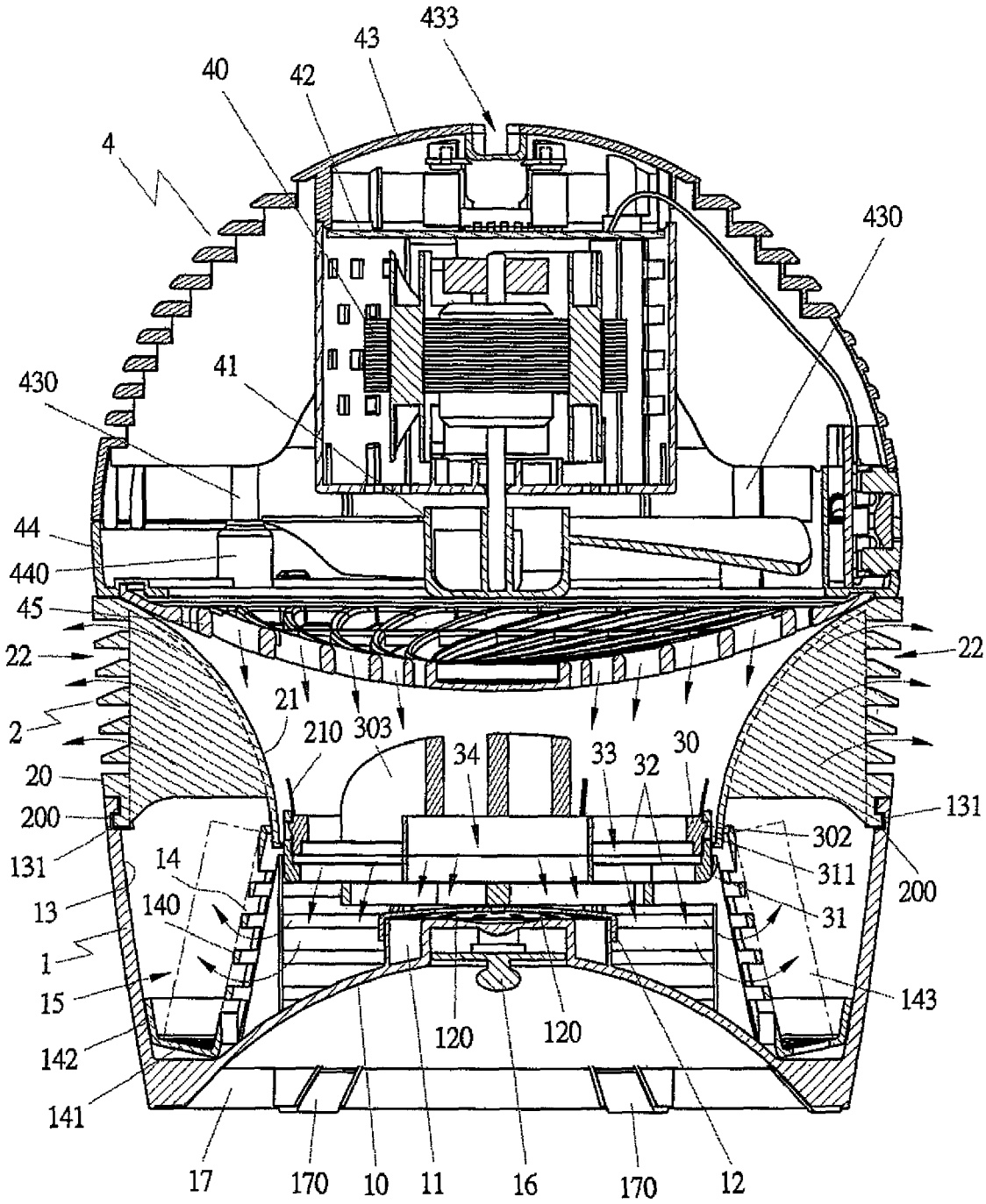
FIG. 6 is a cross-sectional view of the line B-B in FIG. 5.
Figure 7:
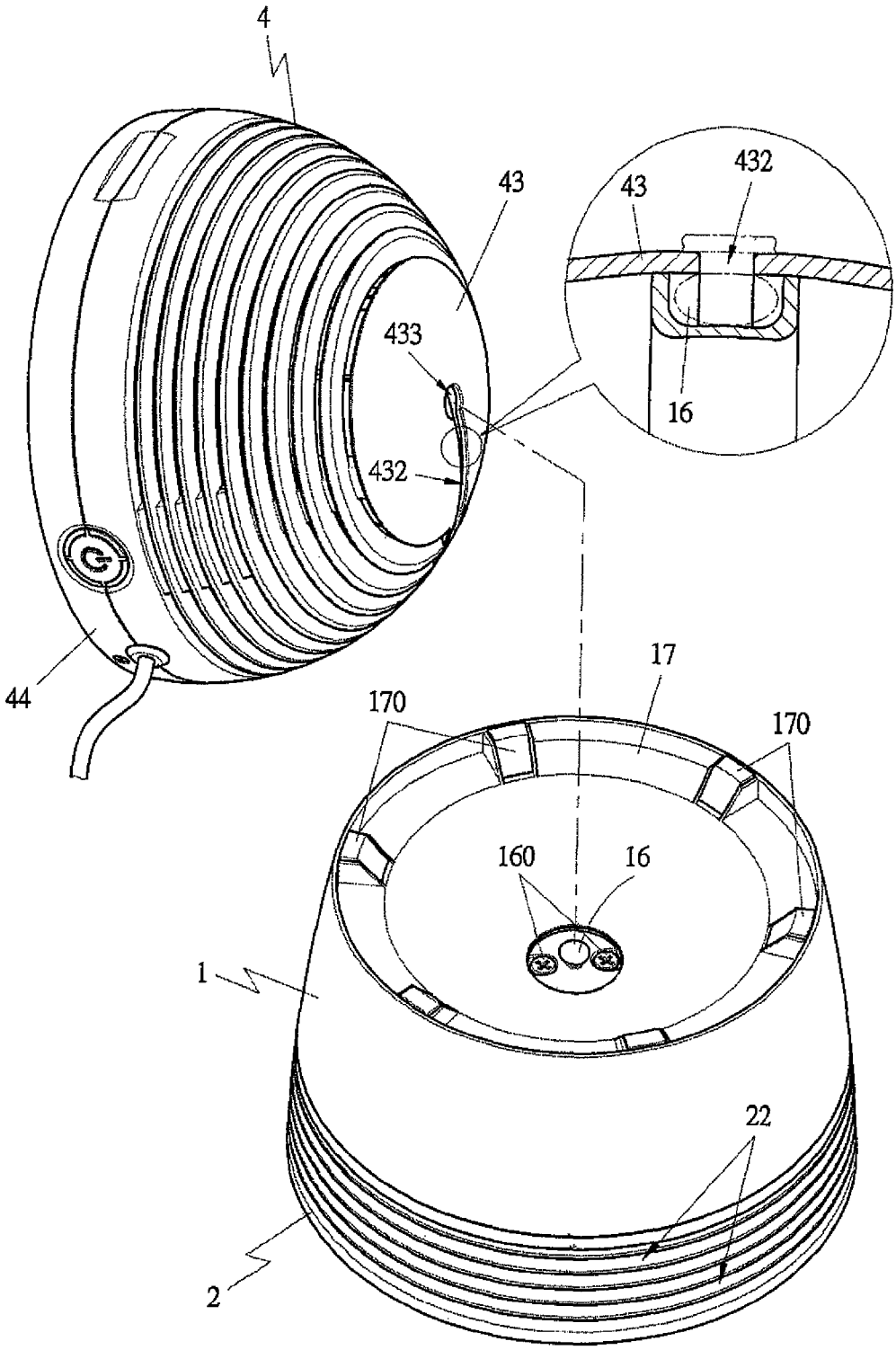
FIG. 7 is a partially exploded perspective view of a second preferred embodiment of a multi-functional air circulation system in the present invention, showing how its main engine is assembled to work independently.

Next, as shown in FIGS. 4 and 6, positioned on the lower flow-guiding surface 10 is a net 14 provided with a plurality of meshes, which can be formed in a same or different shapes, with their number depending on practical requirement and unnecessary to be so dense. The net 14 is provided with an annular slope 140, an annular surface 141 horizontally extending outward around a bottom circumference of the annular slope 140, and an annular upward wall 142 extending up around an outer edge of the annular surface 141, used to accommodate an absorptive paper 143 thereon. Thus, as described above, the net 14 is directly laid on the lower flow-guiding surface 10, with the absorptive paper 143 properly resting in a space 15 formed between it and the annular wall 13 of the base 1. When air flow passes through the absorptive paper 143, it can be humidified by water contained in the absorptive paper 143 to enter a room through exits 22 of the flow-splitting base 2, creating a humid circulation.

Moreover, as shown in FIGS. 1, 4 and 6, the bottom base 1 is also provided with a positioning knob 16 fixed on its bottom by bolting members 160, and a bottom groove 17 having its circumference attached with plural anti-slipping pads 170 for preventing the fan from moving about.

Figure 2:
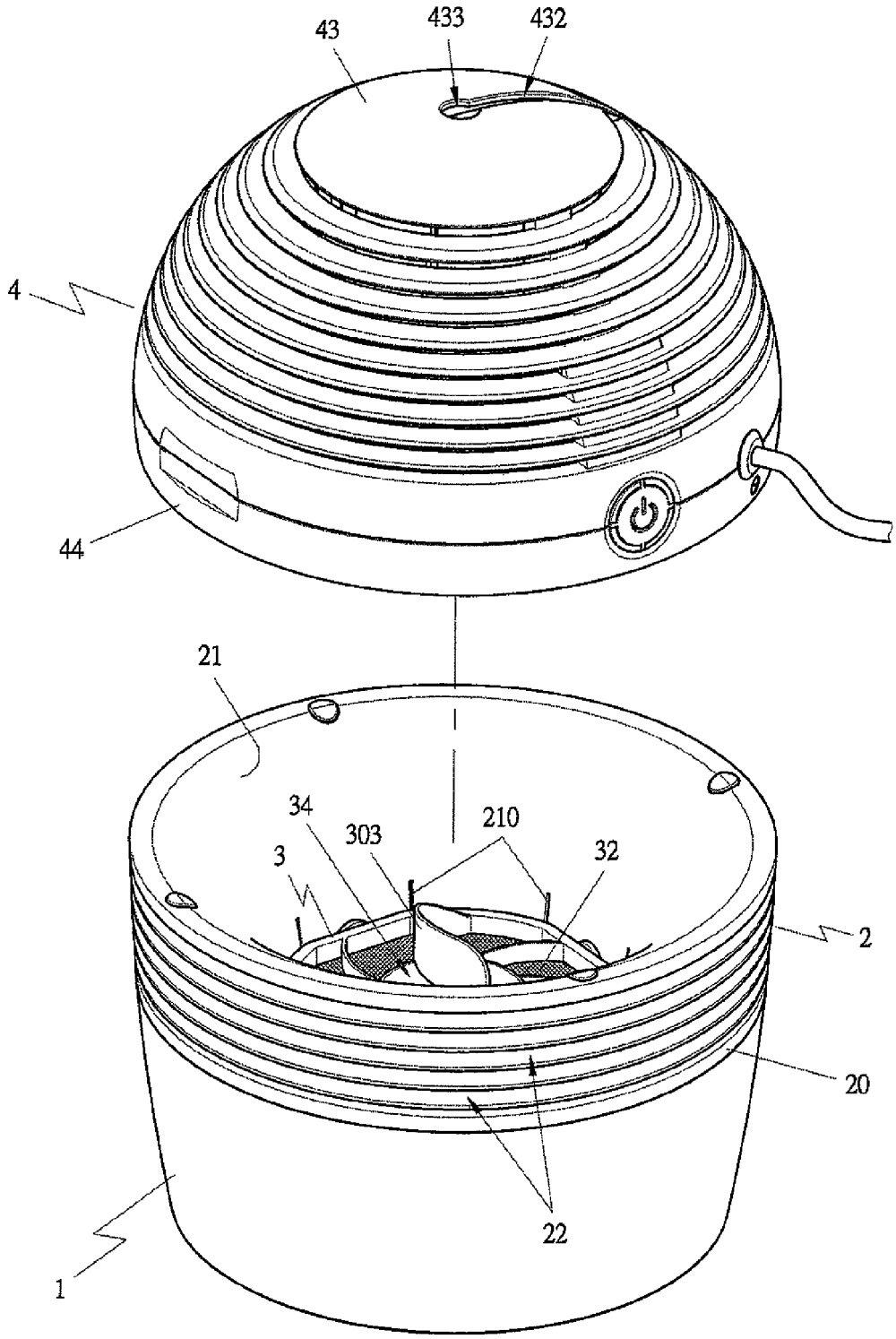
FIG. 2 is a partially exploded perspective view of the first preferred embodiment of a multi-functional air circulation system in the present invention.
Figure 3:
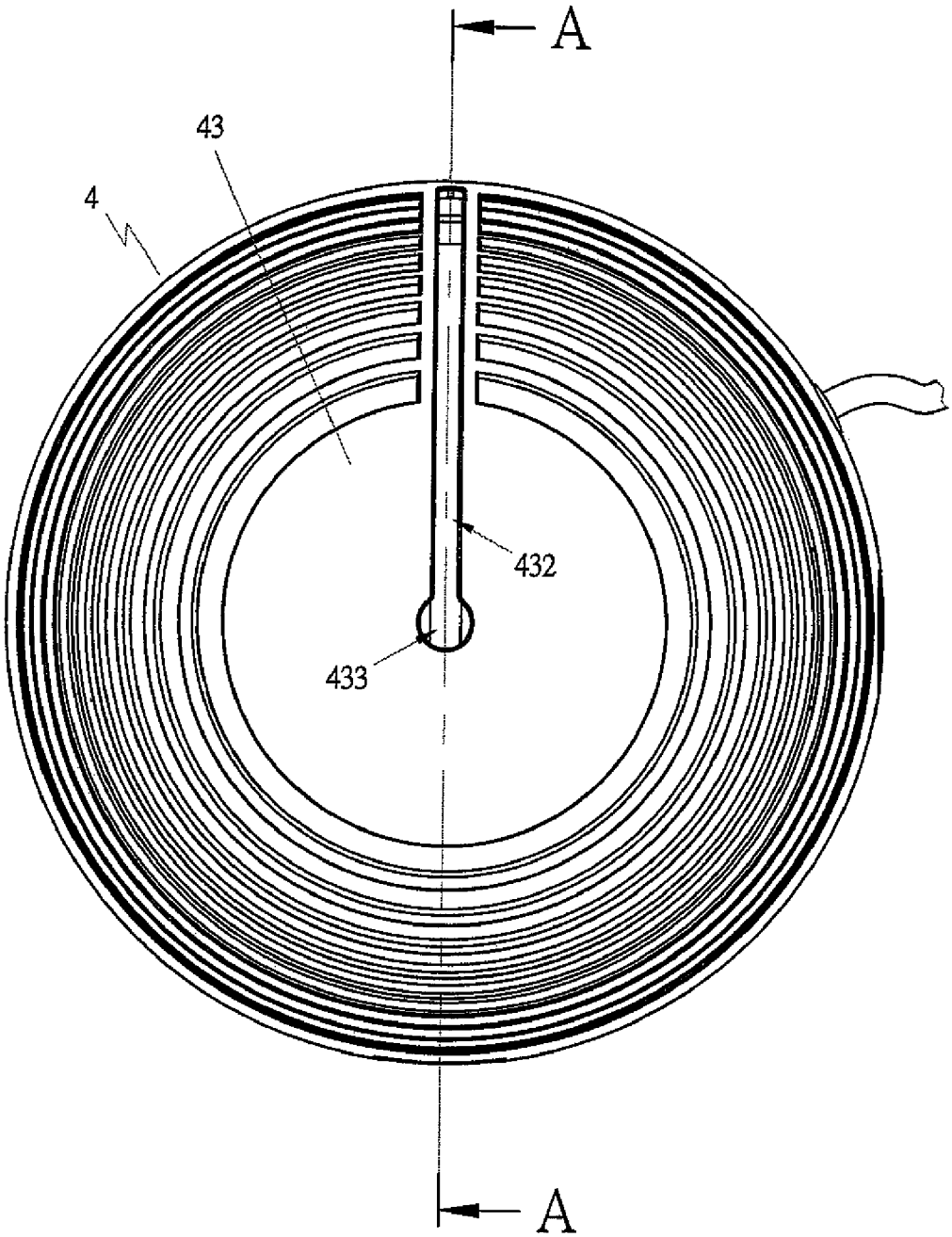
FIG. 3 is a top view of the first preferred embodiment of a multi-functional air circulation system in the present invention.
Figure 5:
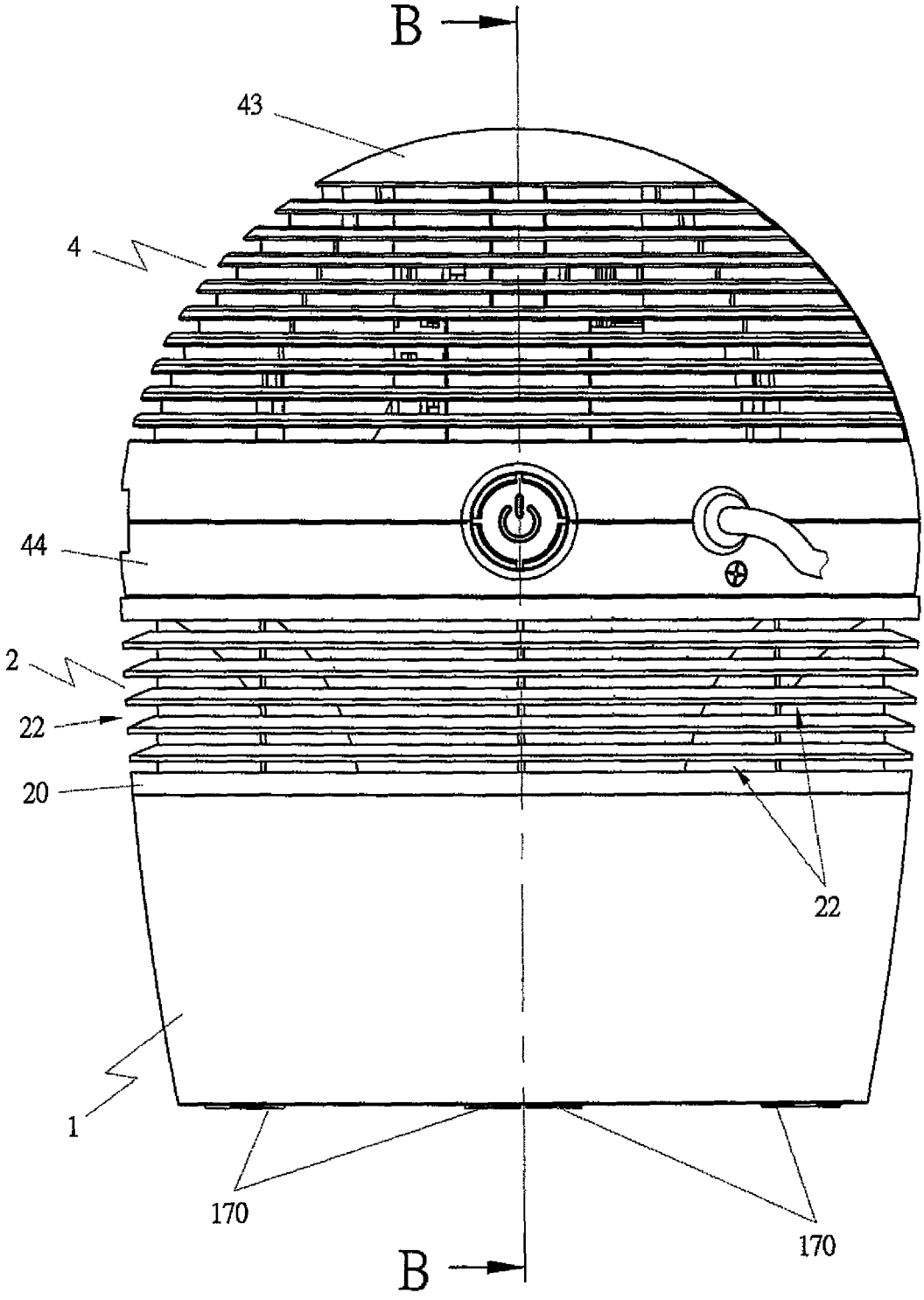
FIG. 5 is a side perspective view of the first preferred embodiment of a multi-functional air circulation system in the present invention.

The flow-splitting base 2 is positioned on the bottom base 1, as shown in FIGS. 1 and 6, including an annular wall 20 provided with a plurality of locking projections 200 for locking with the locking holes 130 of annular wall 13 of the bottom base 1, enabling it quickly and tightly assembled with or easily disassembled from the bottom base 1 without any tools, as shown in FIGS. 2, 4 and 5. An inner flow-guiding surface 21 is as well provided in the flow-splitting base 2, with its diameter gradually shrunk downwards to keep air flow generated by blades of the main engine 4 passing therein to be more concentrated, so that the air flow can be effectively split while flowing through the lower flow-guiding surface 10 of the bottom base 1.

And, as shown in FIGS. 1, 4 and 6, the inner flow-guiding surface 21 is provided with plural thin notches 210 vertically cut equidistantly spaced apart around its bottom edge for appropriately locking with the filter 3 with elastically, and a plurality of inward projections 211 formed around its bottom inner edge. Further, plural annular exits 22 are closely formed in the annular wall 20.

The filter 3 is positioned in an exit of the inner flow-guiding surface 21, as shown in FIGS. 1, 4 and 6, composed of two filter bases 30 and 31 respectively provided with a plurality of meshes 32. The filter base 30 is provided with plural long grooves 301 formed around its circumferential wall 300 for locking with the projections 211 of the inner flow-guiding surface 21 to keep the filter 3 fixed in the exit of the inner flow-guiding surface 21, and plural projections 302 formed around the circumferential wall 300 as well. The filter base 31 is provided with plural small grooves 311 formed around its circumferential wall 310 to be locked with the projections 302 of the filter base 30. Thus, as shown in FIGS. 4 and 6, after having the two filter bases 30 and 31 combined together, a space 33 is formed between them for accommodating environmentally improving agents, such as aromatic powder, active carbon powder or blocks etc. The filter base 30 is provided with a separating plate 303 formed on its top. Each of the filter bases 30 and 31 is provided with a through hole 34 bored at their center for fitting with the upper cap 12 of the bottom base 1, so that air flow can be split by the separating plate 303 after flowing through the inner flow-guiding surface 21, with a large quantity of air rushing to the annular groove 11 to filtrate its impurities and bring aromatic smell into a room.

The main engine 4 mainly includes a motor 40, a blade member 41 fixed with a shaft of the motor 40, and a control system 42. As shown in FIGS. 4 and 6, the motor 40 and the blade member 41 are installed in a rear shell 43. The rear shell 43 includes plural inner-threaded posts 430. The shade also includes a front shell 44 provided with plural inner-threaded posts 440 corresponding to the inner-threaded posts 430 of the rear shell 43. With a bolting member 160 fitted in each corresponding inner-threaded post 430 or 440, the rear shell 43 and the front shell 44 are fixed together. Of course, the rear shell 43 and the front shell 44 can be integrally manufactured as a whole. In addition, an ornamental shell 45 is fixed together with the front shell 44 for beautification. The rear shell 43 and the ornamental shell 46 are respectively provided with plural holes 46. In operation, as the blade member 41 is driven to rotate, air is to be orderly sucked through the rear shell 43, the front shell 44, the ornamental shell 45, the flow-splitting base 2 and the bottom base 1 to enter a room.

Moreover, as shown in FIG. 4, when the blade member 41 of the main engine 4 is initiated to rotate, air in a room will be sucked into the fan through the holes 46 to form an air flow (A), which is to flow through the inner flow-guiding surface 21 of the flow-splitting base 2 to get concentrated and rush down into the bottom base 1. By the time, if an environmental improving agent is laid in the bottom base 1, its fragrance is to be carried by the air flow (A) to flow along the flow-guiding surface 10 of the bottom base 1 and then, through the exits 22 of the flow-splitting base 2 to disperse in a room, achieving an air improved circulation.

Figure 8:
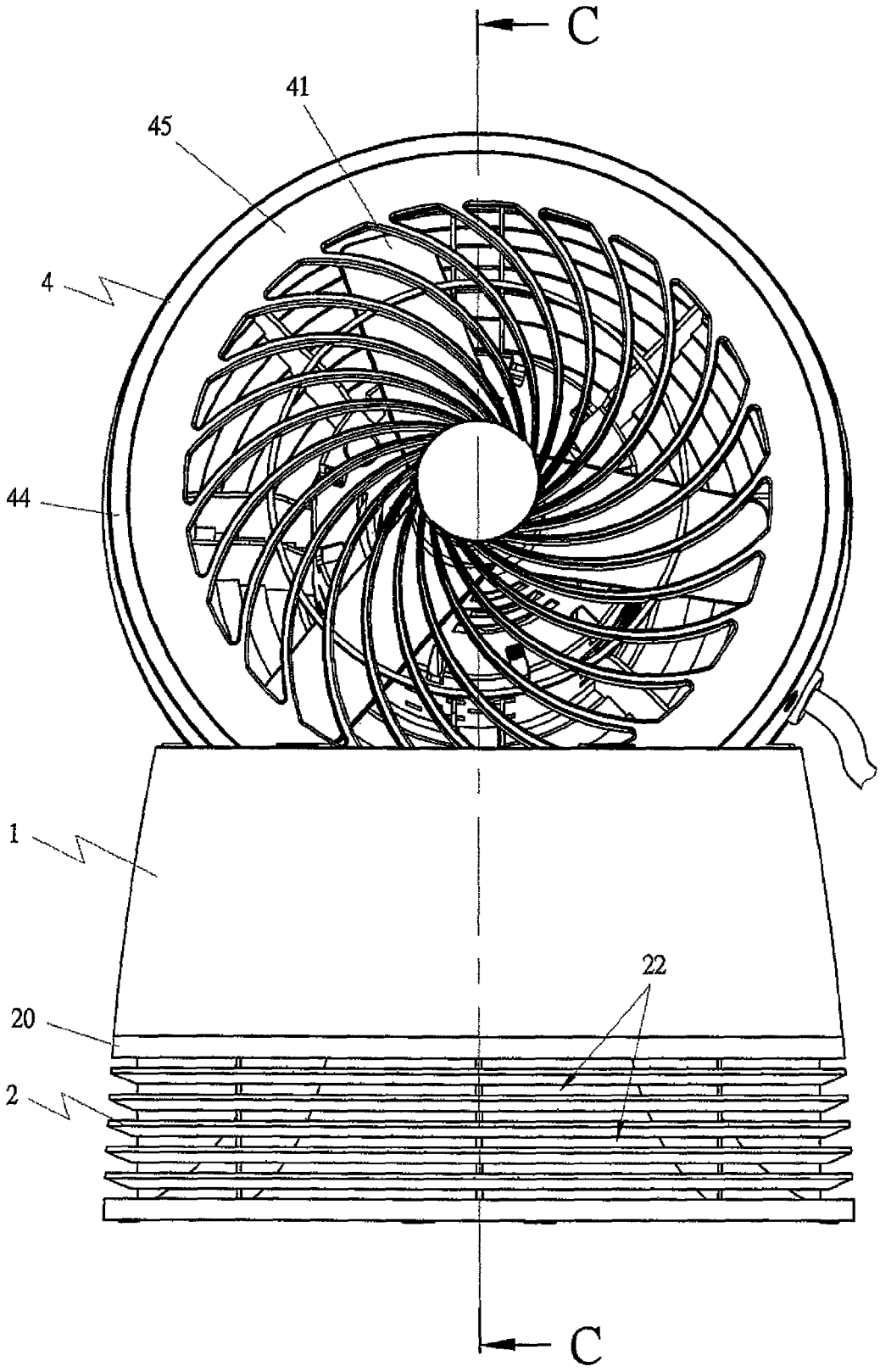
FIG. 8 is a front perspective view of the second preferred embodiment of a multi-functional air circulation system in the present invention, showing its main engine being independently operated.
Figure 9:
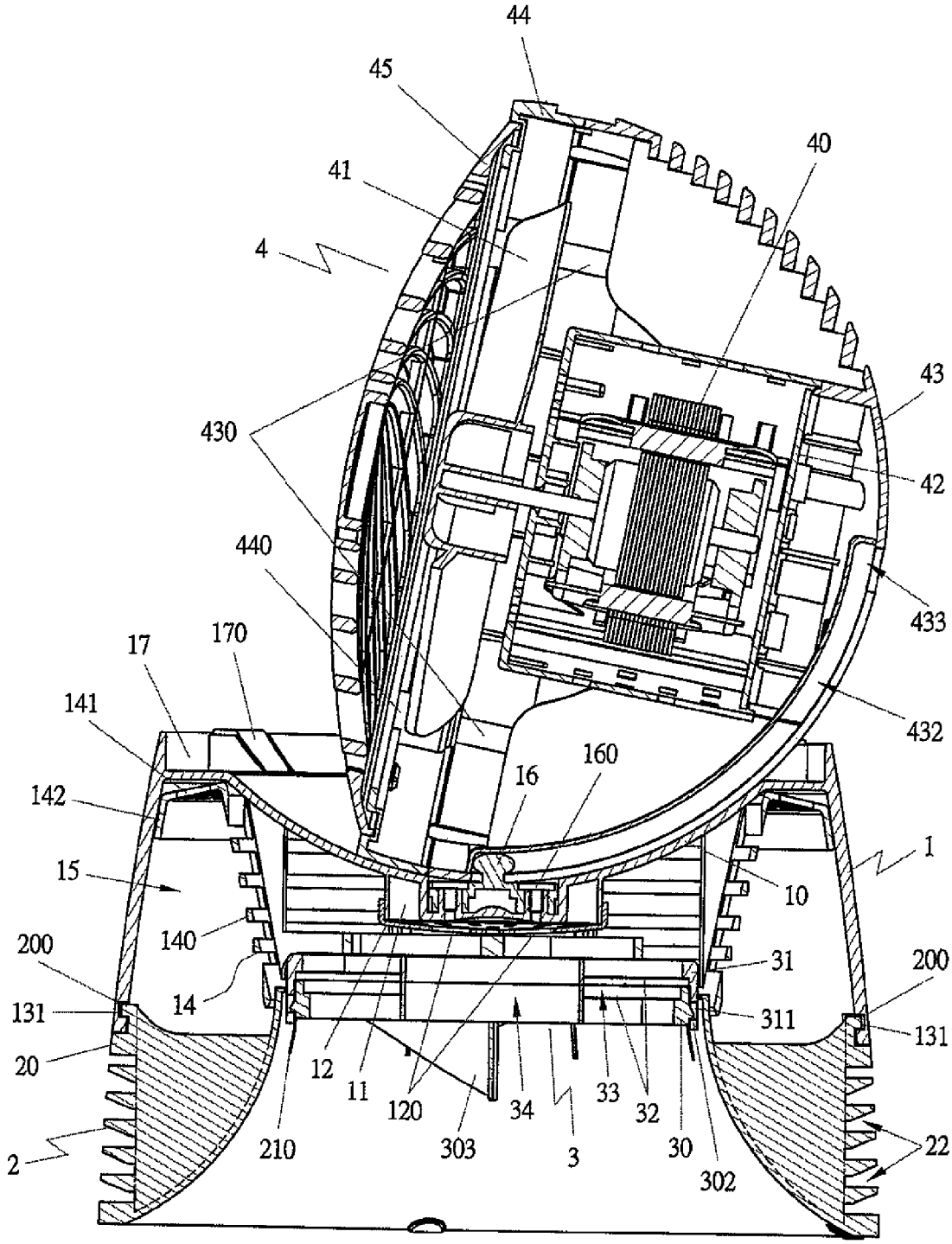
FIG. 9 is a cross-sectional view of the line C-C in FIG. 8.
Figure 10:
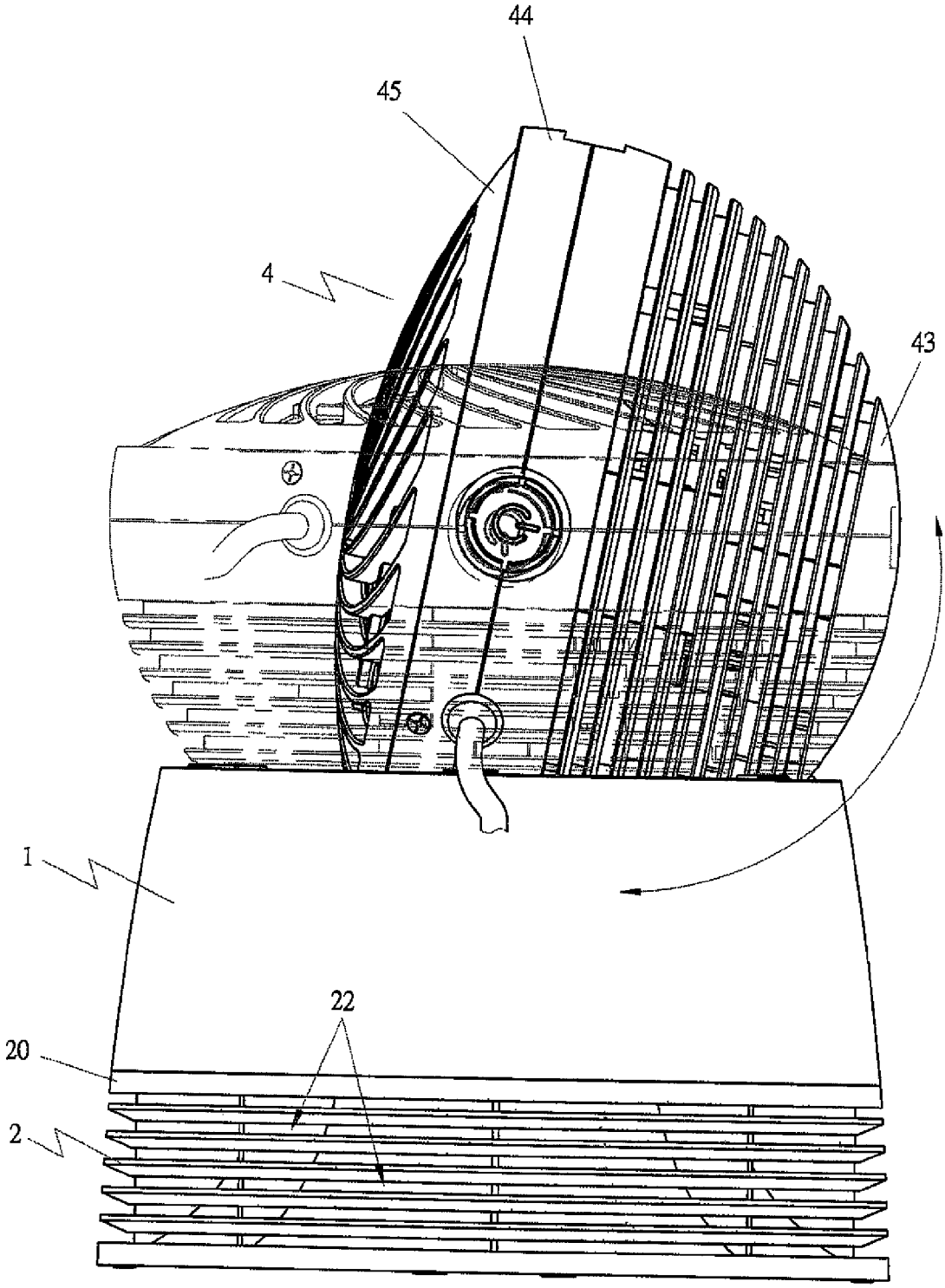
FIG. 10 is a side perspective view of the second preferred embodiment of a multi-functional air circulation system in the present invention, showing its main engine being independently operated in diverse positions.

Next, as shown in FIGS. 7~10, a second preferred embodiment of a multi-functional air circulation system in the present invention has the same components as the first one does, except that the rear shell 43 of the main engine 4 is additionally provided with a long sliding groove 432, and a fitting hole 433 bored at one end of the long sliding groove 432. Thus, the positioning knob 16 of the bottom base 1 can be inserted in the fitting hole 433 to move along the long sliding groove 432, as shown in FIGS. 8~10, so that the main engine 4 can work independently as a circulation tool.

Next, FIGS. 11-14 show a third preferred embodiment of a multi-functional air circulation system, which is modified from the first and the second preferred embodiment illustrated in FIGS. 1-10, having almost the same structure as the first and the second preferred embodiment, except some different structures described below.

The filter 3 is combined with the exit of the inner flow-guiding surface 21 of the flow-splitting base 2, consisting of two filter bases 30 and 31 which are provided with meshes 32.

Figure 11:
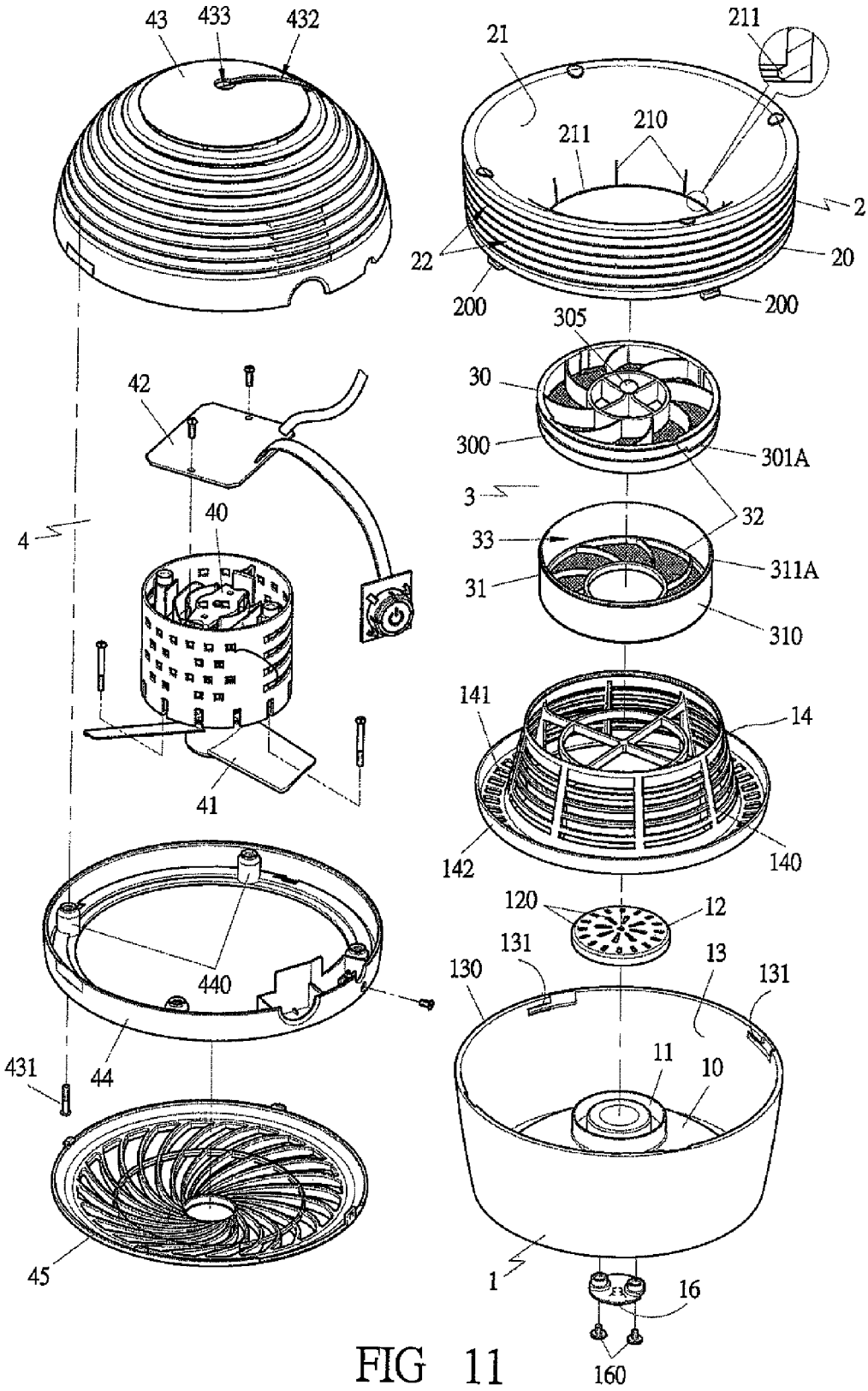
FIG. 11 is an exploded perspective view of a third preferred embodiment of a multi-functional air circulation system in the present invention.
Figure 14:
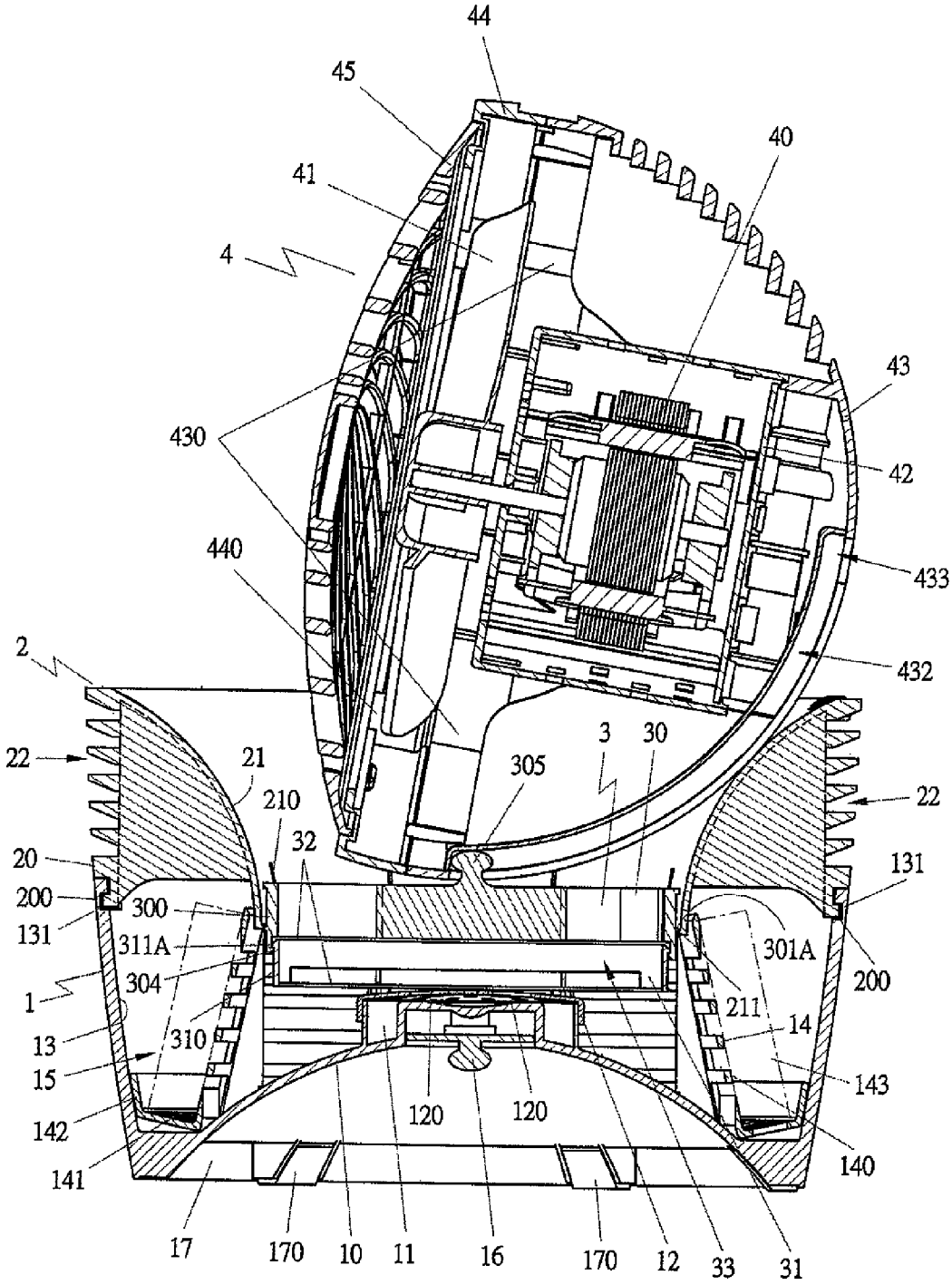

As shown in FIG. 11, the filter base 30 is provided with a fitting annular wall 301A on the circumferential wall 300 to combine with locking projections 211 of the inner glow guiding surface 21 so that the filter base 30 may be fixed tightly in the exit of the inner flow-guiding surface 21, as shown in FIG. 14. Further, the filter base 30 is provided with an annular combining projection 304 inside the circumferential wall 300 to combine with an annular fitting projection 311A provided outside the circumferential wall 310 of the filter base 31. Therefore, as shown in FIG. 14, a space 33 may be formed between the two filter bases 30 and 31 so that environmental improving agents, such as aromatic powder, or dehumidifying agent or active carbon powder (or blocks) may be filled therein.

Figure 12:
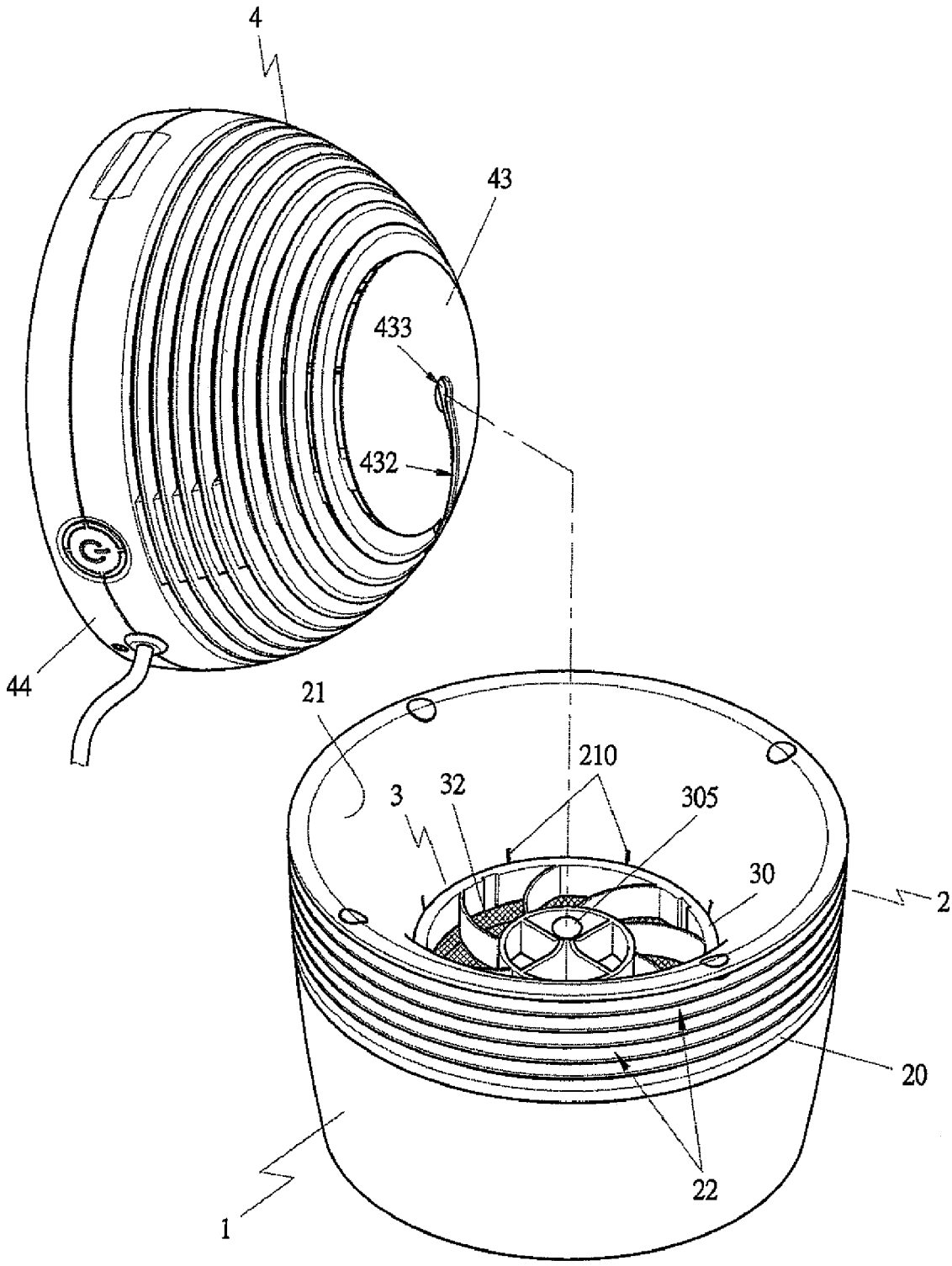
FIG. 12 is a partial exploded perspective view of the third preferred embodiment in the present invention.
Figure 13:
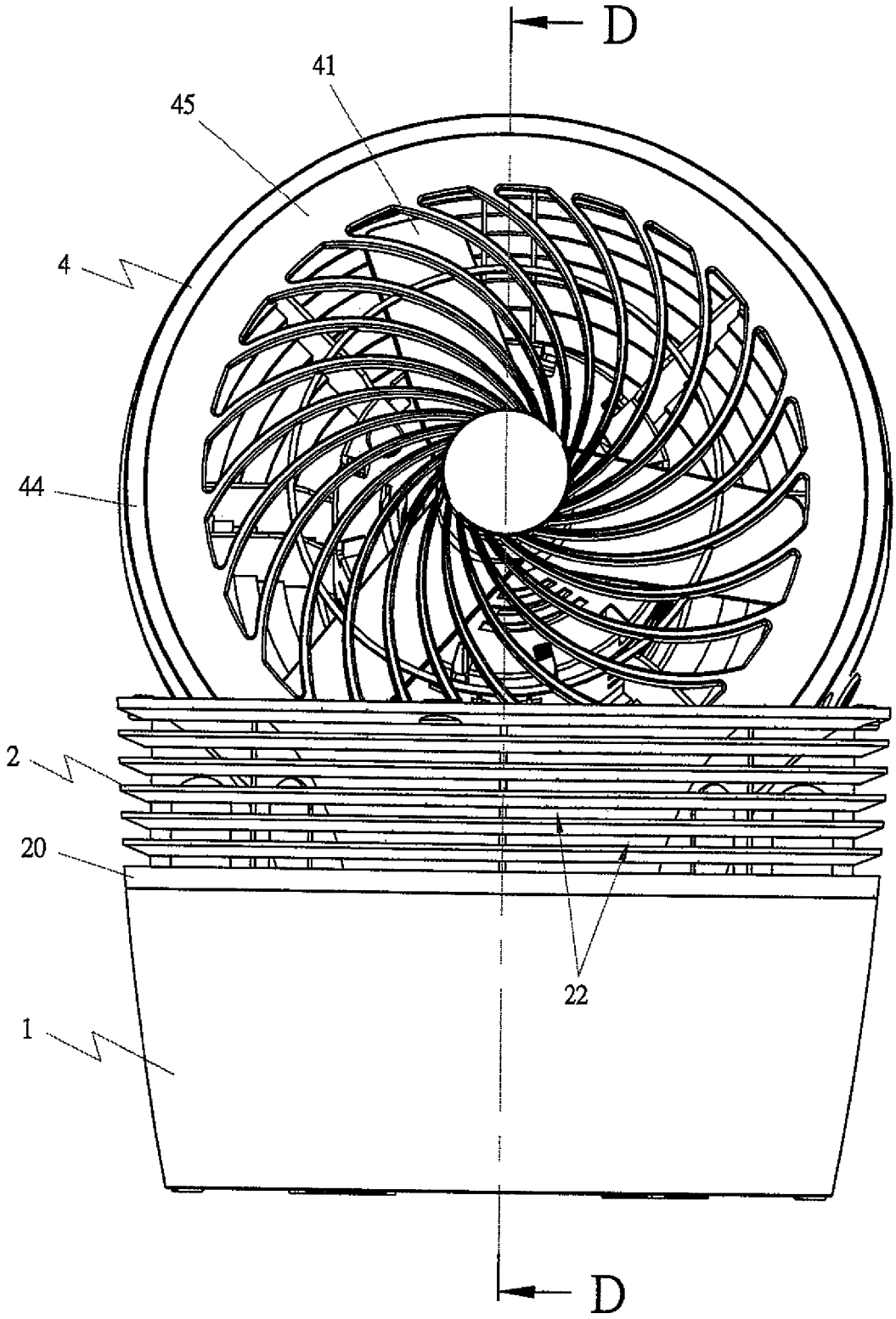
FIG. 13 is a front view of the third preferred embodiment in the present invention, showing it used in an independent way; and, FIG. 14 is a cross-sectional view of the line D-D in FIG. 13.

Next, as shown in FIGS. 11, 12 and 14, the filter base 30 is further provided with a position knob 305 to fit movably in a long sliding groove 432 provided in the rear shell 43 of the main engine 4, and also provided with a hole 433 of a large diameter at the inner end of the long sliding groove 432.

The bottom base 1 is provided with a position knob 16, which is fixed at the bottom of the bottom base 1 by a bolting member 160, and a recess 17 is provided in the bottom of the bottom base 1. Then, the position knob 16 or 305 slides from the hole 433 into the long sliding groove 432 or vice versa, as shown in FIGS. 8-10, or 13 and 14, so the bottom base 1 and the main engine 4 can be combined together in various ways, enabling the main engine 4 with the motor and the fan to be used independently.

The advantages of the invention are described as can be seen from the foresaid description.

With the main engine 4, the flow-splitting base 2 and the bottom base 1 combined together, and with aromatic, active carbon or other fragrant-smelling agents laid in the flow-splitting base 2 or the bottom base 1, the multi-functional fan can generate a fresh and aromatic air circulation. Or, with the main engine 4 combined with the bottom base 1, the multi-functional fan can merely work as a fan.

While the preferred embodiment of the invention has been described above, it will be recognized and understood that various modifications may be made therein and the appended claims are intended to cover all such modifications that may fall within the spirit and scope of the invention.

What is claimed is:

1. A multi-functional air circulation system comprising:

a bottom base provided with a lower flow-guiding surface;

a flow-splitting base positioned on said bottom base and provided with an inner flow-guiding surface, an annular wall, plural annular exits formed closely in said annular wall;

a main engine provided with a motor having its shaft fixed with a blade member, a shade used to cover said motor and provided with plural holes; and said blade member able to suck air in through said holes of said shade while started by said motor and orderly rush it along said inner flow-guiding base of said flow-splitting base and said lower flow-guiding surface of said bottom base and an upper annular wall of said lower flow-guiding surface and said annular exits of said flow-splitting base to enter a room.

2. The multi-functional air circulation system as claimed in claim 1, wherein said inner flow-guiding surface of said flow-splitting base has its diameter gradually shrunk downwards.

3. The multi-functional air circulation system as claimed in claim 1, wherein said lower flow-guiding surface of said bottom base is provided with a bottom groove for containing aromatic, an upper cap sealed on said bottom groove.

4. A multi-functional air circulation system comprising:

a bottom base provided with a lower flow-guiding surface, a net positioned on said lower flow-guiding surface;

a flow-splitting base positioned on said bottom base and provided with an inner flow-guiding surface for guiding air flow generated by a blade member to rush down to said bottom base, an exit of said inner flow-guiding surface installed with a filter that is laid with environmental improving agents; and a main engine provided with a motor having its shaft fixed with a blade member, said motor installed in a rear shell which is combined with a front shell, air sucked in through said rear shell while said blade member is initiated to rotate and then rushed through an ornamental shell to said flow-splitting base and said bottom base to enter a room.

5. The multi-functional air circulation system as claimed in claim 4, wherein plural locking holes are bored near an edge of an upper annular wall of said bottom base.

6. The multi-functional air circulation system as claimed in claim 4, wherein said net of said lower flow-guiding surface is employed to accommodate an absorptive paper and provided with an annular slope, an annular surface horizontally extending outward around a bottom circumference of said annular slope, an upward wall extending up around an outer edge of said annular surface.

7. The multi-functional air circulation system as claimed in claim 4, wherein a space is formed between said net and said annular wall of said bottom base for accommodating an absorptive paper therein.

8. The multi-functional air circulation system as claimed in claim 4, wherein said bottom base includes a bottom groove provided with plural anti-slipping pads located around its circumference.

9. The multi-functional air circulation system as claimed in claim 4, wherein an annular wall of said flow-splitting base is provided with a plurality of locking projections for locking with said locking holes of said annular wall of said bottom base.

10. The multi-functional air circulation system as claimed in claim 4, wherein said inner flow-guiding surface of said flow-splitting base is provided with plural thin notches vertically cut equidistantly spaced apart around its bottom edge for appropriately locking with said filter with elastically.

11. The multi-functional air circulation system as claimed in claim 10, wherein said inner flow-guiding surface of said flow-splitting base is provided with a plurality of projections for locking with long grooves formed around a circumferential wall of a filter base of said filter so as to keep said filter fixed at an exit of said inner flow-guiding surface.

12. The multi-functional air circulation system as claimed in claim 4, wherein said filter is composed of two filter bases respectively provided with plural meshes.

13. The multi-functional air circulation system as claimed in claim 12, wherein one of said filter bases has its circumferential wall provided with plural projections that are employed for locking with small grooves provided in a circumferential wall of the other of said filter bases, a room formed between said filter bases for accommodating environmental improving agents.

14. The multi-functional air circulation system as claimed in claim 4, wherein said filter base of said filter positioned at a top is provided with a separating plate and each of said filter bases of said filter is provided with a through hole.

15. The multi-functional air circulation system as claimed in claim 4, wherein said rear shell and said front shell of said main engine are combined together by bolting members fitted in inner-threaded posts correspondingly provided in each of them.

16. The multi-functional air circulation system as claimed in claim 15, wherein said front shell is combined together with said ornamental shell.

17. A multi-functional air circulation system comprising:

a bottom base provided with a positioning knob fixed at its bottom by bolting members, a bottom groove formed in a bottom of said bottom base;

a main engine having its rear shell provided with a long sliding groove that has a fitting hole formed at its one end; and said positioning knob able to be inserted in said fitting hole and to move along said long sliding groove to become another assembly of said bottom base and said main engine.

18. The multi-functional air circulation system as claimed in claim 17, wherein said bottom base and said main engine are combined together in various ways, by means of said position knob provided in said filter base of said filter moving to and fro in said long sliding groove provided in said rear shell of said main engine.

* * * * *